US006588337B1

(12) United States Patent
Kreckel et al.

(10) Patent No.: US 6,588,337 B1
(45) Date of Patent: Jul. 8, 2003

(54) METHOD AND APPARATUS FOR AUTOMATICALLY CLEANING BOTH THE BLANKET CYLINDER AND THE INK ROLLERS OF A PRINTING PRESS

(75) Inventors: H. Martin Kreckel, Westerly, RI (US); William R. Schneider, Baldwin, NY (US); Edward E. Marganski, Ansonia, CT (US); Richard P. Rubin, Fairfield, CT (US)

(73) Assignee: Baldwin Graphic Systems, Inc., Shelton, CT (US)

( * ) Notice: Subject to any disclaimer, the term of this patent is extended or adjusted under 35 U.S.C. 154(b) by 0 days.

(21) Appl. No.: 09/560,100

(22) Filed: Apr. 28, 2000

(51) Int. Cl.[7] ..... B41L 41/00
(52) U.S. Cl. ..... 101/424; 101/423; 101/483
(58) Field of Search ..... 101/424, 425, 101/423, 483; 15/256.51, 256.52; 134/153, 151

(56) References Cited

U.S. PATENT DOCUMENTS

| | | | | | |
|---|---|---|---|---|---|
| 4,270,450 | A | * | 6/1981 | Difflipp et al. | 101/425 |
| 4,344,361 | A | | 8/1982 | MacPhee et al. | 101/425 |
| 4,757,763 | A | | 7/1988 | MacPhee et al. | 101/425 |
| 4,967,664 | A | * | 11/1990 | Iijima | 101/424 |
| 5,176,080 | A | | 1/1993 | Gasparrini et al. | 101/425 |
| 5,277,111 | A | * | 1/1994 | Uribe et al. | 101/425 |
| 5,367,955 | A | | 11/1994 | Hara et al. | 101/424 |
| 5,893,327 | A | * | 4/1999 | Dengel et al. | 101/425 |
| 5,911,175 | A | * | 6/1999 | Sondergeld et al. | 101/424 |
| 5,964,157 | A | * | 10/1999 | Hummel et al. | 101/424 |
| 6,042,655 | A | * | 3/2000 | Hara et al. | 101/425 |
| 6,047,640 | A | * | 4/2000 | Murakawa | 101/423 |
| 6,135,025 | A | * | 10/2000 | Zimmer | 101/129 |

FOREIGN PATENT DOCUMENTS

| | | |
|---|---|---|
| WO | 0 334 173 A1 | 9/1989 |
| WO | 0 692 381 A2 A3 | 1/1996 |
| WO | 1 000 740 A1 | 5/2000 |
| WO | WO 01/83216 | 11/2001 |

OTHER PUBLICATIONS

Brochure describing Model FS05 from Formsprag Company (Warren, Michigan).

* cited by examiner

*Primary Examiner*—Anthony H. Nguyen
(74) *Attorney, Agent, or Firm*—Morgan & Finnegan, LLP

(57) ABSTRACT

A system and method of a combination and sequencing of a first cleaner around a blanket cylinder, a second cleaner around one of the rollers in an ink form roller assembly, and a fluid applicator around another one of the rollers in the ink form roller assembly effectively clean the press rollers and the blanket cylinder used in a printing machine.

7 Claims, 1 Drawing Sheet

METHOD AND APPARATUS FOR AUTOMATICALLY CLEANING BOTH THE BLANKET CYLINDER AND THE INK ROLLERS OF A PRINTING PRESS

BACKGROUND OF THE INVENTION

1. The Field Of The Invention

The present invention relates generally to a method of cleaning printing presses, and, more particularly, to a method of simultaneously cleaning both the press rollers and the blanket cylinder of a printing press.

2. Description of Related Art

In order to maintain high quality printing, it is necessary to periodically clean the rollers and cylinders of a printing press. Since the cleaning process necessarily results in press "down time," it is highly desirable that the amount of "down time" be minimized while at the same time obtaining effective cleaning and drying of the cylinders.

There are five areas of a printing press: impression, transfer, blanket, plate, water train and ink train. In the past, each of these areas has been heretofore cleaned separate and apart from one another. Various methods have been employed ranging from manual cleaning by a press operator to mechanical means which have been either manually operated or operated in a semi-automatic mode. These various methods have had varying degrees of success measured by amount of time required to thoroughly clean the various areas of the press, materials expended, danger to human limb, amount of volative organic compounds (VOC) released into environment, wear on existing parts/finishes and thoroughness of cleaning One of the more difficult and time consuming tasks in a printing operation is the need to periodically clean the various printing press rollers and cylinders, such as the blanket cylinder, impression cylinder, plate cylinder and, in particular, the ink rollers (collectively referred to as an "ink roller train") of ink and other debris. These cleaning operations are sometimes referred to by those skilled in the art as "washings" or "washup" operations. Such washup operations are needed to remove extraneous paper dust, debris, and other contaminants from the ink roller train to improve the quality of the printed product.

The ink roller train is usually cleaned when a printing color is changed or during a pause of a printing operation. Ink roller washings are tedious operations, often requiring significant (and sometimes dangerous) manual intervention on the part of the press operator. The individual rollers of the ink roller train must be separated to access in order to clean all the rollers and cylinders. The separation and cleaning of the roller train could take as long as 20 minutes.

Traditionally, the print operator usually "squirts" or otherwise applies a cleaning solvent directly onto the print cylinders and ink roller train. The solvent loosens the ink and other debris from the cylinders and ink rollers, which is then scraped off or otherwise removed from the printing press. The scraping operation is a messy and time consuming task, and in the past has involved manually wiping the surface of the cylinders and rollers so that the solvent, along with the ink and other solid debris, can be collected in a trough or pan, or alternatively, captured by a rag or some other absorbent material. Therefore, a need exists for an improved and efficient system for cleaning the cylinders of a printing press that reduces clean-up or down time, and reduces the chance of injury to someone assigned to clean the press.

As an alternative to manually cleaning the printing press, the washup operation has been performed by devices designed to engage the cylinders or ink rollers and scrape off the ink or other debris. One such device includes, for example, a cleaning blade adapted to engage the ink roller and scrape debris from the ink rollers into an ink pan. However, it is frequent that the blade is inadequately cleaned following a washup operation and that the geometry of the blade tip is altered with subsequent washings, lowering both the effectiveness of the blade in cleaning the press rollers, and lessening the effective life expectancy of the blade. The disposal of the ink scraped off the roller train and collected in the ink pan is also of concern. The pan must be removed, emptied and cleaned from the next roller train cleaning operation which is a messy operation in itself. Since cloths and a solvent are used to clean the ink pan, operator's hands are often smeared requiring additional cleanup. Furthermore, because this ink pan cleaning has to be repeated for the cleaning of each roller train, the process is inefficient.

Such tasks are tedious, time consuming and messy, and result in prolonged periods of press downtime while the operator cleans the stained components. As a result of these inconveniences it is often the case that washups are neglected by the operator, causing undue wear to the components and lessening their life expectancy.

Another device includes a cylinder or roller cleaner having an inflatable bladder which fills with air, or other gases, to move a cleaning cloth into engagement with the surface of the cylinder or roller and remove debris. However, the current cylinder or roller devices using an inflatable bladder are constructed and adapted to focus on and clean only one roller at a time, not multiple rollers.

There exists a need, therefore, for a washup device and method for cleaning the blanket cylinders and virtually all rollers in an ink train assembly used in printing machines which facilitates the automation of washings operations while cleaning virtually all the rollers and all cylinders by one system; which is easily retrofitted into existing printing presses without the need for complicated additions; which reduces the amount of volative organic compounds released into the environment; and, which virtually eliminates the down time and effort necessary to clean the cylinders and rollers of the printing press.

3. Summary of the Invention

The present invention solves these and other needs as apparent from the following description. The embodiments of the present invention was developed to clean all the cylinders and rollers of a printing press by automatic means.

One embodiment of the present invention features a blanket cleaner arranged around the blanket cylinder and an ink roller cleaner arranged around one of the ink rollers of the ink roller train, respectively, and a fluid applicator. The fluid applicator is arranged to apply a fluid to at least one ink roller of the ink roller train. Usage of the two cleaners located at appropriate positions within the printing press and application of an appropriate fluid to the ink roller train results in an environmentally friendly cleaning of both the blanket cylinder and the rollers of the ink roller train in a substantially reduced amount of time.

In another embodiment, the cleaners are activated according to a sequence. In the sequence, one of the cleaners can be first activated for a first duration of time. The remaining cleaner is activated for a second duration of time. Finally, the fluid applicator is activated to apply the fluid to the ink roller train for a third duration of time. The duration of time for which each cleaner is activated is variably adjusted as is the sequence of operation of the first and second cleaners and the fluid applicator to substantially clean both the blanket cylinder and the ink roller train.

In a further embodiment, a computerized controller is included to automatically control the sequence of operation and the respective durations of operation for the first and second cleaners and the fluid applicator.

In yet another embodiment, at least one of the cleaners includes a pre-soaked cloth.

The invention also includes the method of cleaning both the blanket cylinder and the ink roller train of a printing press. The method includes activating a blanket cleaner arranged around the blanket cylinder for a first duration of time. An ink roller cleaner arranged around an ink roller of the ink roller train is then activated for a second duration of time. Finally, a fluid spray applicator arranged around an ink roller of the ink roller train is then activated.

BRIEF DESCRIPTION OF DRAWING

The accompanying drawing illustrates one embodiment of the invention.

DETAILED DESCRIPTION OF THE PREFERRED EMBODIMENTS

Figure 1:
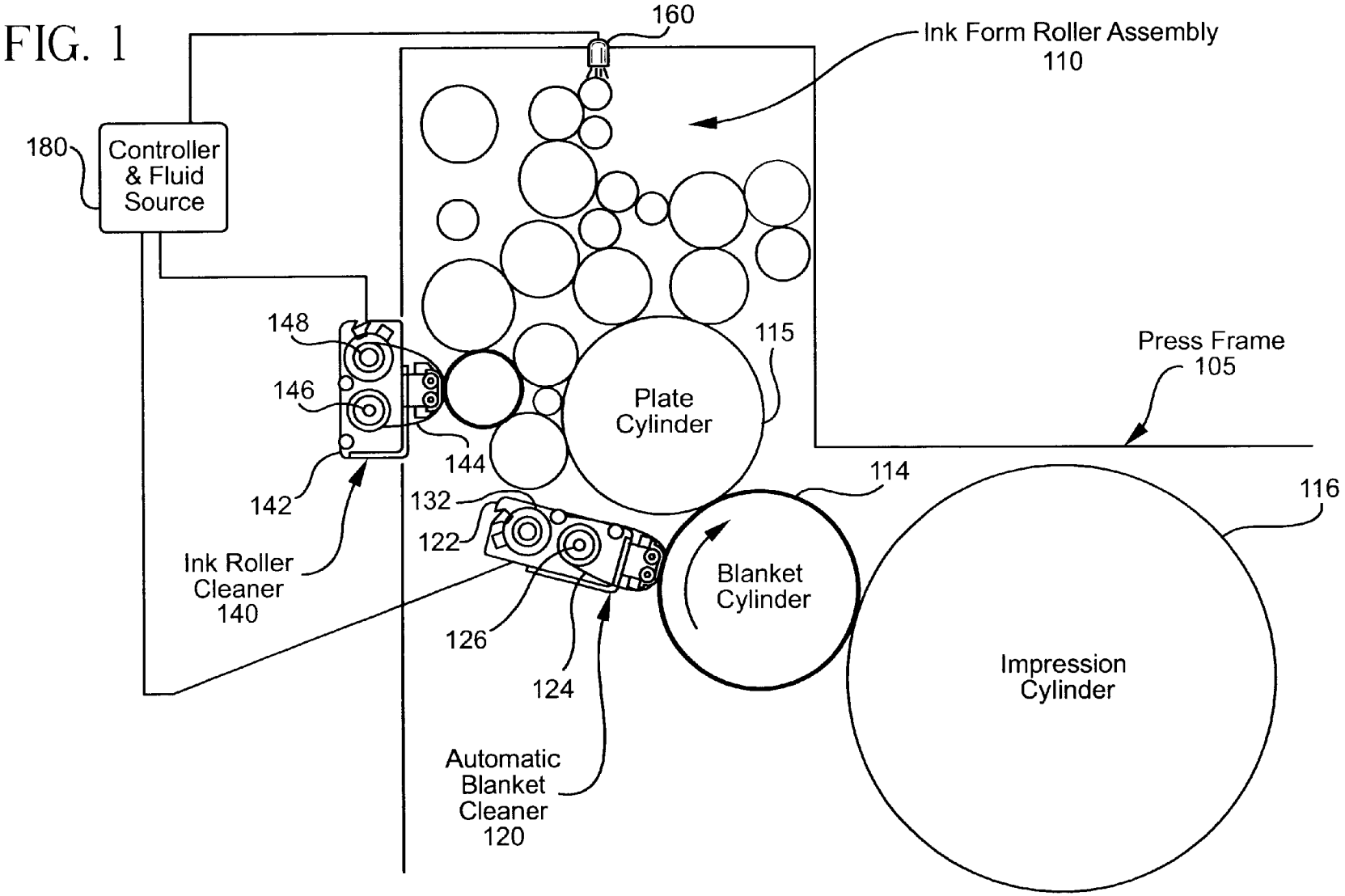
FIG. 1 is a cross-sectional view of an overall printing press including two cleaners and fluid applicator, each appropriately placed.

Certain preferred embodiments of the present invention will now be described in detail with reference to the drawing. FIG. 1 generally depicts an overall printing press system including an ink roller train (ink form roller assembly) 110, a plate cylinder 115, a blanket cylinder 114, and an impression cylinder 116.

One specific embodiment will now be described with reference to FIG. 1. As illustrated in FIG. 1, an apparatus for automatically cleaning both the blanket cylinder and the ink rollers of a printing press includes a blanket cleaner 120 arranged around the blanket cylinder 114, an ink roller cleaner 140 arranged around one of the ink rollers of the ink roller train 110 at a first ink roller location, and a fluid applicator 160 arranged around another one of the ink rollers at a second ink roller location.

The blanket cleaner 120, arranged around the blanket cylinder 114, includes side frames 122, mounted by conventional means to the press frame 105 of the printing press, a cleaning cloth 124, a cleaning cloth supply roll 126, a cleaning cloth take-up roll 128, means for moving (not shown) the cleaning cloth into engagement with the surface of the blanket cylinder, and means for advancing (not shown) the cleaning cloth 122 onto the take-up roll 128. For convenience, only one of the side frames is illustrated.

The cleaning cloth supply roll 126 and the cleaning cloth take-up roll 128 are mounted on side frames 122. Each side frame 122 includes a number of guide pins that serve as cloth guides for the cleaning cloth 124.

The cleaning cloth supply roll 126 provides the cleaning cloth 124 for the cleaning cloth take-up roll 128. The cleaning cloth 124 is adapted to contact the blanket cylinder 114. In one embodiment, the cleaning cloth is pre-soaked with a cleaning solvent. The use of a pre-soaked cleaning cloth permits construction of a more compact blanket cleaner because there is no need for a solvent spray head or solvent supply tank. However, it is within the scope of the present invention to include such a solvent spray head or solvent supply tank in order to supply the cleaning agent to the cleaning cloth and, ultimately to the blanket cylinder and rollers of the ink roller train, as will be described in more detail.

The fabric of the cleaning cloth is absorbent to both water and solvent and is uniform in its absorbency. The cleaning cloth has sufficient abrasion resistance so as not to shed lint or other particles. The cloth also has mechanical strength to avoid breakage while being soft enough so as not to scratch the blanket cylinder. One such suitable pre-soaked cleaning cloth is that sold under the trademark PREPAC®.

In the present embodiment, the means for moving the cleaning cloth into engagement with the surface of the blanket cylinder is an inflatable bladder. By filling the bladder with air under pressure, the surface of the bladder will move the cleaning cloth into engagement with the surface of the blanket cylinder.

The use of a flexible bladder as the means for moving the cleaning cloth 124 into engagement with the surface of the blanket cylinder 114 provides a more compact construction of the blanket cleaner 120. With the flexible bladder, there is no need for complicated and expensive mechanisms to move the entire blanket cleaner 120. In addition, the bladder provides a relatively wide and uniform stripe along the cylinder which substantially eliminates the presence of streaks on the cylinder after cleaning. Furthermore, the bladder is not easily contaminated with ink and is cleaned much easier than a brush, or the like, having bristles. The use of a flexible bladder also provides a mechanical cleaning means or scrubbing means to loosen debris on the cylinder while cleaning the cylinder.

In alternate embodiments, the means for moving the cleaning cloth 124 into engagement with the surface of the blanket cylinder 114 are solid pads, pivotable blades or moveable rollers that are actuated by any of a number of means, including motors, and actuators, known in the art.

The blanket cleaner 120 also includes means for advancing the cleaning cloth 124 onto the take-up roll 128. In one embodiment, the cleaning cloth advancing means 132 includes a one-way clutch mechanism. One-way clutches are not shown in detail since they are conventional in construction and are commercially available. One suitable one-way clutch mechanism is available as Model FS05 from Formsprag Company (Warren, Mich.). In alternate embodiments, the cleaning cloth advancing means is a step motor, continuous motor, ratchet and pawl arrangement, solenoid and the like. The advancing means advances the cloth 124 independently of the amount of cloth on the take-up roll 128 and minimizes the possibility of the cloth 124 being drawn into the press. The cleaning cloths are removed from the cleaners after a finite amount of cleaning operations have occurred.

Alternate advancing means are set forth in U.S. Pat. No. 5,176,080, issued Jan. 5, 1993 to Gasparrini, for a Cloth Supply System For Blanket Cylinder For Use in Printing Presses, which is incorporated herein by reference.

Further information about the construction and operation of cleaners for blanket cylinders and rollers in an ink roller train is set forth in U.S. Pat. No. 4,344,361, issued Aug. 17, 1982, to MacPhee et al., and its continuation, U.S. Pat. No. 4,757,763, issued Jul. 19, 1998, for an Automatic Blanket Cylinder Cleaner, and in U.S. Pat. No. 5,367,955, issued Nov. 29, 1994 to Hara et al. for a Method and Device For Cleaning An Ink Roller Train For Use In Printing Machines, all of which are incorporated herein by reference.

The second or ink roller cleaner 140 is constructed similar to the first or blanket cleaner 120 described above. The ink roller cleaner 140 is arranged around one of the ink rollers in the ink roller assembly 110.

The ink roller cleaner 140 includes a cleaning cloth 144, a cleaning cloth supply roll 148, a cleaning cloth take up roll 146, means for moving (not shown) the cleaning cloth into engagement with the surface of one of the rollers in the ink form roller assembly 110, and means for advancing (not shown) the cleaning cloth 144 onto the take-up roll 146.

Similar to the blanket cleaner, the cleaning cloth supply roll 148 provides the cleaning cloth 144 for the cleaning cloth take-up roll 146. In the present embodiment, the fabric, properties and construction of the cleaning cloth 144 for the ink roller cleaner 140 are identical to that of the cleaning cloth 124 for the blanket cleaner 120. The cleaning agent of the ink roller cleaner 140 can be a different concentration than the cleaning agent used by the blanket cleaner 120.

The activation of the blanket and ink roller cleaners 120, 140, as described in more detail below, assures that a cleaning agent is transferred throughout the roller assembly 110 by running the printing machine, while disengaging the ink supply. The blanket and ink roller cleaners 120, 140 also remove the ink, excess cleaning agent and debris from the cylinders and rollers in the printing press by their engagement with the cleaning cloths 124, 144.

In alternate embodiments, the blanket cleaner 120 and the ink roller cleaner 140 can be stationary or moveable on a track system so as to be engageable with other rollers or cylinders of the printing press. The blanket and ink roller cleaners 120, 140 can also be moved intermittently or continuously while contacting the rollers or cylinders.

The cleaning agent from the cleaners 120, 140 softens and thins out the ink remaining on the rollers of the roller train in the printing press.

In one embodiment, fluid applicator 160 dispenses fluid, such as, for example, water or a water substitute from a dispensing tank by conduit means in specific quantities and at specific pressures onto one of the rollers in the ink roller assembly 140 adjacent to the ink fountain roller. Operation is effected by fluid control devices that direct the solvent, water or other cleaning liquids to spray in specific quantities for a specific duration. The fluid is transferred through the roller train to the blanket cylinder by running the printing machine. The fluid works to break down or thin out the cleaning agent applied to the cylinders and rollers of the printing press by the blanket and ink roller cylinders 120, 140 and rinse the rollers, removing the oily film still on the roller surfaces.

In alternate embodiment, fluid applicator 160 is a spray-type (i.e. spray bar) which includes a plurality of spray nozzles opposed to one of the rollers in the ink roller assembly. A supply of fluid is connected to the spray nozzles through a plurality of solenoid operated valves to spray the fluid onto the roller. The roller cooperates with the other rollers and cylinders of the printing press to feed the fluid to the blanket cylinder. The spray bar can be engaged with or without oscillation imported by an optional motor.

Spray bars are well known in the art, although any mechanism known in the art to apply fluid to the ink rollers may be used. Fluid may be added by any manual or automated means known in the art for removal of any remaining residual build-up on rollers and cylinders.

The operation of the cleaning system will now be described in more detail according to one embodiment of the invention.

Initially, the blanket cleaner 120 at the blanket cylinder location is activated for a first duration of time to distribute cleaning agent to the blanket cylinder 114 which is then transferred to the plate cylinder 115 and then, by the cooperation of the rollers in contact, to the rollers in the ink roller assembly 110 by the running of the printing press. The cleaning agent works its way up through the ink roller train by transferring the cleaning agent through the contact of the cylinders and ink rollers. Next, the ink roller cleaner 140 is activated for a second duration of time at the first ink roller location, along with the blanket cleaner 120, to aid in distributing the cleaning agent throughout the entire ink roller assembly 110 while the press continues to run.

Finally, the fluid applicator 160 is activated, for a third duration of time, during the second cleaner duration at the second ink roller location to distribute the fluid throughout the rollers and cylinders in the printing press, while the printing press is running and the Cleaners 120, 140 collect the excess cleaning agent, fluid and debris from the rollers and cylinders. The duration of time for each cleaner activated can be variably adjusted as is the sequence of operation of the blanket cleaner 120 and the ink roller cleaner 140 and the fluid applicator 160.

In an alternate embodiment, the blanket cleaner 120 at the blanket cylinder location and the ink roller cleaner 140 at the first ink roller location are activated at the same time to distribute the cleaning agent to the cylinders and rollers of the roller assembly 110. Then, the fluid applicator is activated to distribute the thinning agent throughout the roller assembly 110.

The use of the blanket cleaner 120, the ink roller cleaner 140 and the fluid applicator 160, together, creates a system for cleaning virtually all of the cylinders and rollers of the printing press by automatic means.

It is believed that both the cleaners 120, 140 are needed to effectively distribute the cleaning agent throughout the ink roller train, because of the path the cleaning agent takes from the blanket cylinder or any of the ink rollers. Each cleaner and the fluid applicator, operated independently, does not thoroughly clean all of the cylinders and the ink rollers in one operation as described in relation to the embodiments of the present invention.

As will be understood by one skilled in the art, in each of the embodiments described, the printing press system may include a controller 180 to coordinate operation of the washer system. Notably, the controller 180 (i.e. computer) may be configured to control the operation of the cleaners 120, 140 and the fluid applicator 160. The controller 180 is provided with an operator panel having various controls, so that the press operator may enter system parameters such as which cleaner to engage, the amount and duration of cleaning agent supply (spray time), the duration of engagement of the cleaners (clean time) and the like.

The fluid applicator 160 may feature a fluid control box, controlled by the system controller 180 that is in communication with a fluid source for controlling the supply of fluid from a central supply. The control box features solenoid operated valves for regulating the flow of the fluid therethrough. Operation of the solenoids (which are operatively connected to the system controller) controls the flow of the fluid to the cylinders. By entering the appropriate information into the control panel, the press operator may control operation of the individual solenoid in the control boxes to regulate the supply of fluid to the cylinders.

Accordingly, the embodiments of the present invention provide a system for cleaning virtually all of the rollers and cylinders in a printing press. The fluid applicator and the cleaners, used as a system, eliminate the need to separate all of the cylinders and cleaning the various sections of the printing press at different times, thus reducing the downtime and avoiding injury to operators.

It is understood that the system of the present invention may include more than two cleaners and more than one fluid applicator arranged around other ink rollers and non-ink rollers, such as the blanket cylinders or impression rollers.

Furthermore, since numerous modifications and variations will readily occur to those skilled in the art, it is not desired that the present invention be limited to the exact construction and operation illustrated and described herein, and accordingly, all suitable modifications and equivalents which may be resorted to are intended to fall within the scope of the claims.

What is claimed is:

1. An apparatus for simultaneously cleaning both the blanket cylinder and press rollers of a printing press, comprising:

a fluid applicator arranged to apply a fluid to a first roller of an ink roller train;

a first cleaner having a first cleaning cloth arranged around the blanket cylinder; and a second cleaner having a second cleaning cloth arranged around a second roller of the ink roller train, wherein the fluid applicator applies the fluid independent from the first and second cleaners.

2. The apparatus according to claim 1, further comprising a fluid source in fluid communication with the fluid applicator.

3. The apparatus according to claim 2, wherein the fluid is selected from the group consisting essentially of water, solvent and cleaning agent.

4. The apparatus according to claim 3, wherein the cleaners are activated according to a sequence such that one of the cleaners is first activated for a first duration of time, the remaining cleaner is activated for a second duration of time, and the fluid applicator is activated to apply the fluid to the ink roller train, wherein the first and second durations of time and the sequence of operation are variably adjusted to substantially clean both the blanket cylinder and the ink roller train.

5. The apparatus according to claim 4, further comprising a computerized controller to automatically control the sequence of operation and the respective duration of operations for the first and second cleaners and the fluid applicator.

6. The apparatus according to claim 1, wherein at least one of cleaners includes a pre-soaked cloth.

7. A method of cleaning both a blanket cylinder and an ink roller train of a printing press, comprising:

activating a first cleaner having a first cleaning cloth arranged around the blanket cylinder for a first duration of time;

during the first duration of time, activating a second cleaner having a second cleaning cloth arranged around a second ink roller of an ink roller train for a second duration of time; and during the first and second duration of time, activating a fluid spray applicator independent from the first and second cleaners and arranged around a first ink roller of the ink roller train for a third duration of time.

* * * * *